United States Patent [19]

Nabben

[11] 4,385,552

[45] May 31, 1983

[54] EXHAUST FAN AND ANTI-BACKDRAFT SHUTTER ASSEMBLY

[76] Inventor: Marvin Nabben, 3521 46th Ave. S., Minneapolis, Minn. 55406

[21] Appl. No.: 254,995

[22] Filed: Apr. 16, 1981

[51] Int. Cl.[3] ..... F24F 13/10

[52] U.S. Cl. ..... 98/116; 98/43 R; 267/155; 415/146

[58] Field of Search ..... 98/116, 43 R; 415/209, 415/146; 49/89; 267/58, 155; 137/512.1

[56] References Cited

U.S. PATENT DOCUMENTS

| | | | |
|---|---|---|---|
| 2,541,665 | 2/1951 | Prudhon | 98/116 X |
| 2,605,097 | 7/1952 | Masoner | 267/155 |
| 2,750,185 | 6/1956 | Moore | 267/155 |
| 2,823,413 | 2/1958 | Stewart | 267/155 X |
| 3,965,926 | 6/1976 | Buckner | 132/512.1 |
| 4,005,732 | 2/1977 | Buckner | 137/512.1 |
| 4,257,444 | 3/1981 | Ogle, Jr. et al. | 137/512.1 X |
| 4,257,451 | 3/1981 | Paton | 137/512.1 |

*Primary Examiner*—William E. Tapolcai

*Attorney, Agent, or Firm*—Kinney, Lange, Braddock, Westman & Fairbairn

[57] ABSTRACT

Two anti-backdraft shutters are each supported in an exhaust fan assembly casing on a set of upper and lower parallel support arms. Outer ends of each set of these arms are pivotably mounted in the casing in closely adjacent relation to the other set on substantially vertical axes in closely adjacent relation to an exhaust fan motor and between the motor and an intake port defining the intake end of the casing. The shutters can move between an open position in almost parallel relation to each other with the fan-motor in between under the action of air being exhausted, and a closed position where the shutters close off the entire intake port. A coil spring urges the shutters to move toward closed condition.

2 Claims, 3 Drawing Figures

EXHAUST FAN AND ANTI-BACKDRAFT SHUTTER ASSEMBLY

BACKGROUND OF THE INVENTION

This invention has relation to exhaust fan assemblies wherein shutters are provided which are forced open by the action of air passing through the assembly when the fan is operating and which are biased to return to a closed position when it is not.

Such assemblies are not new, but anti-backdraft exhaust fan assemblies of the prior art suffered from certain difficulties which have been overcome in the present invention.

A most desirable attribute of such assemblies is that the air pressure needed to hold the shutters in open position be kept at a bare minimum to maximize the energy efficiency of the unit. In other words, the energy of motion of the air against the shutter blades to hold them open is entirely lost, so the less flat plate area presented by the shutter mountings and shutters while in their open position, the better.

Also in this regard use of two shutters is much better than use of many shutters in providing for minimum restriction to air flow.

Third, where only two blades are used, these shutters can be positioned at the exhaust end of the assembly, or at the intake end. If positioned at the intake end, the motor and fan assembly is substantially elongated to have room to let the blades swing clear back to substantially parallel position with respect to the air flow and still clear the electric motor, in accordance with the teachings of the prior art. If positioned at the exhaust end, they will be out in the weather. Such a structure is unsatisfactory and/or unworkable in areas where there is considerable snow and sleet during a given year.

Fourth, when a series of horizontally pivoted narrow shutters are positioned at either the intake or exhaust end, virtually the entire weight of the shutter must be supported by the air flow, and this results in a waste of energy.

Additionally, shutters, whether horizontally or vertically pivoted, do collect dust over long periods of time. The added weight of such dust does not appreciably affect vertically pivoted shutters, but greatly inhibits full opening of horizontally pivoted shutters.

Shutters, whether horizontally or vertically mounted, on the outside or exhaust port end of an exhaust fan assembly are subject to action by transient cross winds and by winds directly against them which can sporatically cause the shutters to open to allow undesirable backdraft or can present a pressure on the shutters which will tend to hold them closed against the action of the exhaust fan when it is turned on.

Therefore, what has been needed, and what is provided by the present invention, is an exhaust fan and anti-backdraft shutter assembly in which the shutters are pivotally mounted in adjacent relation to the intake port of the assembly and between the motor-fan and this intake, and which does necessitate use of a bulky structure on which the shutters pivot. The shutters should be openable easily when the fan operates and, when the fan is not operating, should be rather gently biased to move to a closed, anti-backdraft position.

No preliminary search was made on this invention. However, the inventor and those in privity with him are aware of no prior art which is closer than that dicussed above, and are aware of no prior art which anticipates the claims made herein.

BRIEF SUMMARY OF THE INVENTION

An exhaust fan assembly includes a casing having an air passage through it, the air passage being partly defined by intake and exhaust ports. An exhaust fan motor and fan blade unit are mounted in the casing passageway with the motor adjacent the intake port and the fan blade adjacent the exhaust port. Each of a pair of anti-backdraft shutters is pivotally mounted on a substantially vertical axis in the casing passageway, the pivotal mountings being on axes adjacent to each other and adjacent the motor drive shaft at the end of the motor opposite the fan blade. Each shutter is supported on its own pair of upper and lower parallel shutter support arms. In the form of the invention as shown, these arms extend substantially horizontally outwardly from upper and lower vertically aligned edge corners of the shutter, respectively. The support arms extend substantially perpendicularly outwardly from the shutters, and a shutter pivot finger extends vertically at right angles to the outer end of each such support arm. The arrangement is such that the weight of the shutter does not appreciably affect the energy needed to maintain the shutters in open position so the shutters can be made of very durable relatively heavy steel plate.

The spacing of these elements is such that the shutters can move between an open position wherein they approach parallel relationship with respect to each other with the motor in between them under the action of air being exhausted by the motor and fan, and a closed position wherein the shutters are in sealing relation to each other and to the casing intake port when the fan is not operating. This arrangement requires much less housing depth than that required by prior art structures.

Also, in the form of the invention as shown, a coil spring is positioned in surrounding relation to the two uppermost shutter pivot fingers and acts on the upper shutter support arms to bias the shutters to move from open toward closed position. It is within the spirit of the invention, however, to employ other bias means for this purpose, including, for example, sufficiently horizontally offsetting the upper pivot fingers from the lower pivot fingers so that the shutters are biased toward closed position by the action of gravity.

IN THE DRAWINGS

FIG. 1 is a longitudinal horizontal sectional view of an exhaust fan and anti-backdraft shutter assembly of the present invention with an exhaust fan motor shown in full, the assembly being mounted in an outer wall of a structure to be ventilated;

FIG. 2 is a vertical sectional view taken on the line 2—2 in FIG. 1 but with the exhaust fan motor and motor mounting straps omitted for purposes of clarity.

DESCRIPTION OF PREFERRED EMBODIMENT

Figure 3:
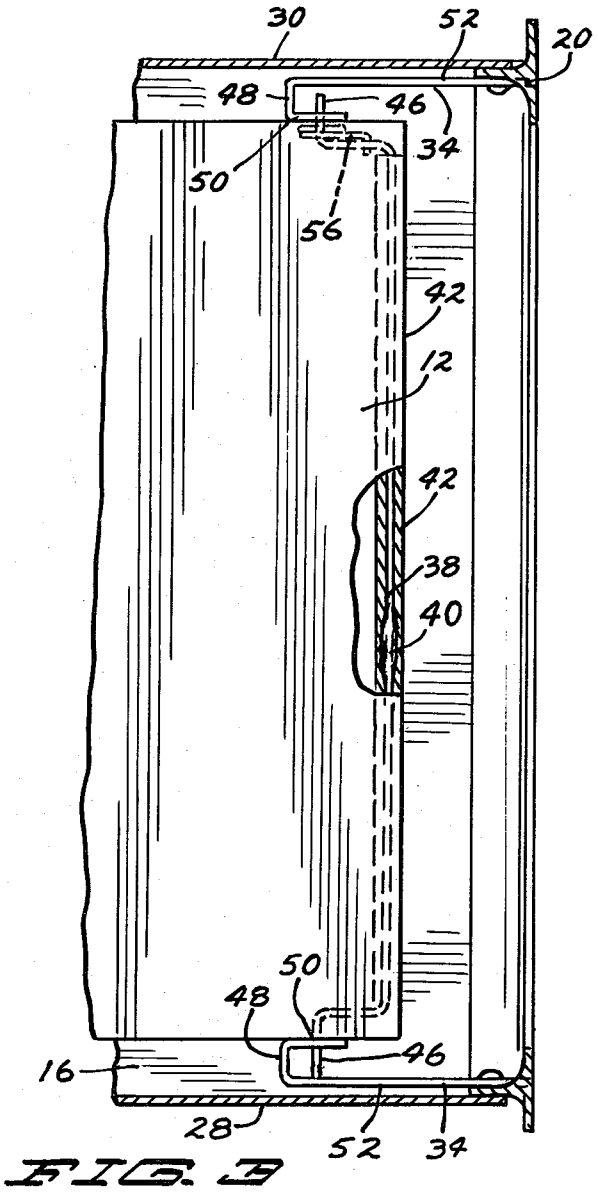
FIG. 3 is an enlarged vertical sectional view taken on the line in FIG. 2.
Figure 7:
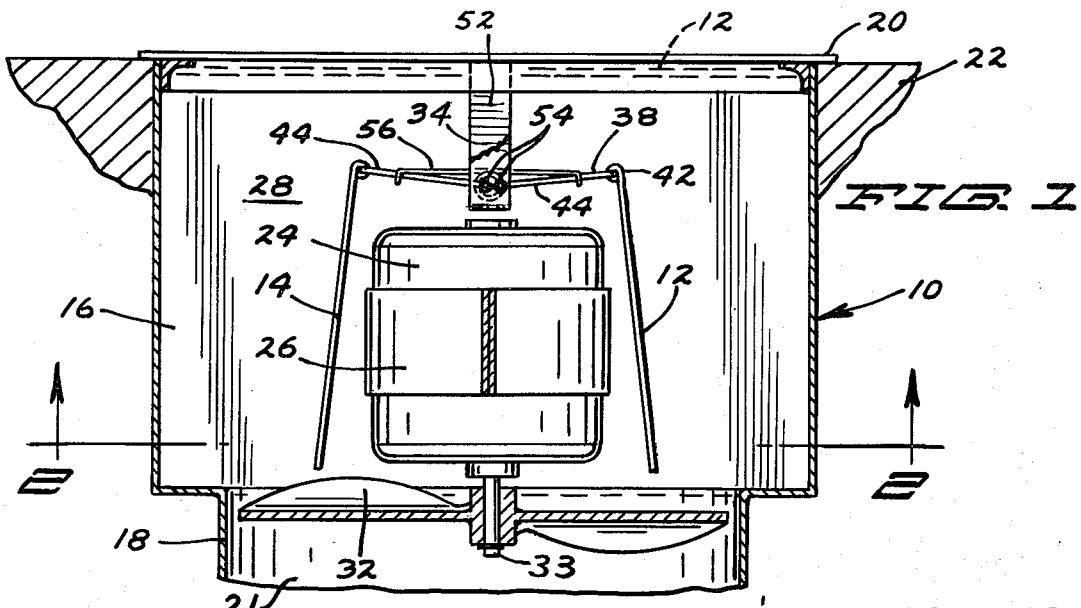
Figure 8:
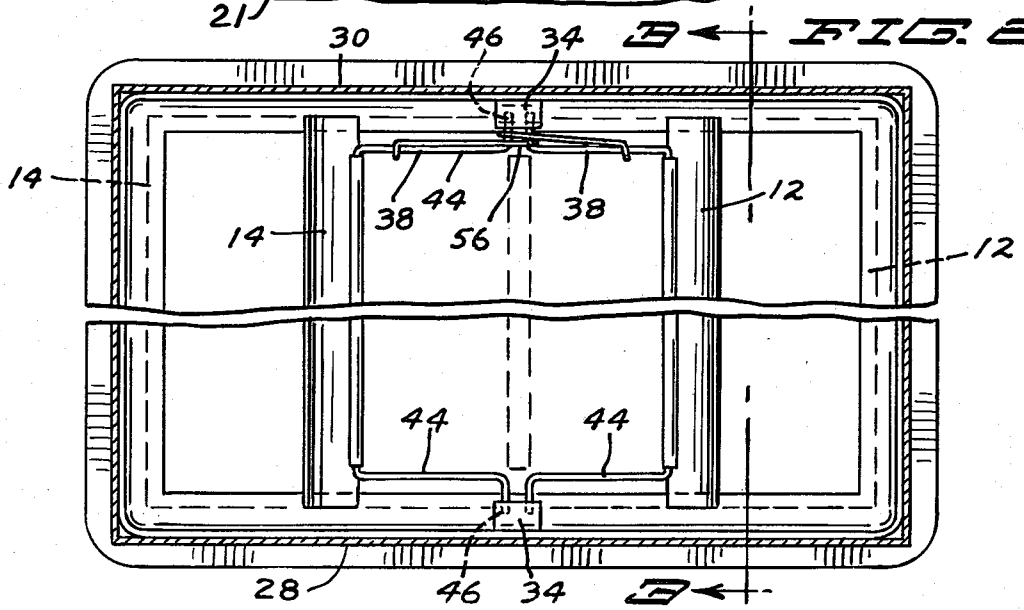

The exhaust fan and anti-backdraft shutter assembly of the present invention includes a casing 10 to be mounted in an outer wall 22 of a farm building to be ventilated. Anti-backdraft shutters 12 and 14 are pivotally mounted in a rectangular housing 16 forming a part of the casing 10 in such a manner as to be movable between an open position and a closed position in sealing relationship with respect to an intake port or rectangular housing frame 20. This port or frame 20 can be made of plastic or of metal or other suitable material.

A cylindrical housing 18 is open to the rectangular housing 16 and also forms a part of the casing 10. The portion of the housing 18 farthest from the intake port 20 forms an exhaust port 21.

An exhaust fan motor 24 is fixedly mounted in the center of the rectangular housing 16 through the instrumentality of motor mounting straps 26 which are, in turn, fixedly mounted with respect to upper wall 28 and lower wall 30 of the housing 16 in any usual or preferred manner (not shown).

A fan blade 32 is operably connected to a motor drive shaft 33 extending from the fan motor 24, the fan blade being mounted in consecutively closedly spaced relationship from the cylindrical wall of the cylindrical housing 18.

Upper and lower shutter mounting brackets 34,34 are fixedly mounted with respect to the top and bottom edges of the rectangular housing frame or intake port 20, respectively, and extend horizontally in direction toward fan motor 24. Each of these brackets has a flat shank portion 52 and a generally J-shaped end portion 48. These end portions 48 terminate in flat sections 50 which are parallel with each other and with the flat shank portions 52. Each such flat section 50 of each mounting bracket is provided with a pair of spaced-apart shutter support rod pivot holes 54,54, each aligned vertically with a corresponding support rod pivot hole 54 in the other bracket, in the form of the invention as shown.

Each of the shutters 12 and 14 is provided with a mounting bead or protrusion 42 along one of its vertical edges. A generally U-shape shutter support rod 38 for each shutter has a straight vertical central portion 40 which is intimately bonded down the center of this bead 42. This bonding is of such a nature that there can be no rotation of the shutter support rod with respect to the shutter. A pair of parallel shutter support rod arms 44,44 are integral with and extend perpendicularly and horizontally away from the central portion 40 of the support rod 38. An outer end of each of these rod arms is provided with a perpendicularly and vertically extending shutter pivot finger 46, the two fingers 46,46 being vertically aligned with each other on an axis parallel to the longitudinal axis of central portion 40 of rod 38.

Each of the fingers 46,46 of each of the shutters 12 and 14 are mounted in one of the sets of vertically aligned support rod pivot holes 54,54.

A coil spring 56 extends around both of the upper shutter pivot fingers 46,46 and has spring arms extending out and around the upper rod arms 44 of each of the shutters. The spring 56 acts on each of the arms and therefore on each of the shutters to urge it to move toward a closed position such as the position as seen in dotted lines in FIGS. 1 and 2. When in this closed position, the innermost vertical edges of each of the shutters will be in sealing relationship with respect to the other, and the top, bottom and outside edges of each of the shutters will be in sealing relationship with respect to the input port.

OPERATION

The structure of the invention is useful to intermittently exhaust air from inside of a building to be ventilated and to prevent outside air from passing back into the building when the air is not being exhausted.

In operation, the strength of spring 56 will be such that as soon as exhaust fan motor 24 is activated, drive shaft 33 will rotate fan blade 32 to draw air through the casing 10 to the inside of the building, and this differential in pressure will immediately cause the shutters 12 and 14 to move to position as seen in full lines in the drawings. As soon as the motor is deactivated, and the fan blade 32 quits turning, pressure in the casing 10 will be equalized, and the spring 56 will carry both of the shutters back to sealing relationship with respect to each other and with respect to the rectangular housing frame 20. This effectively prevents any backdraft from outside of the ventilated building to the inside thereof due to wind gusts or the like.

Also, the structure is such that the entire flat plate area of the opening in the rectangular housing frame is available for withdrawing and exhausting air from the building being ventilated, and that air is carried over, around and through the exhaust fan motor to insure that the motor is properly cooled at all times while it is operating.

While the anti-backdraft shutters 12 and 14 are shown in the drawings as being urged toward a closed position with respect to the housing frame 20 through the instrumentality of a coil spring 56, it is to be understood that by properly positioned the shutter support rod pivot holes 54,54 in the upper shutter mounting bracket 34 with respect to those pivot holes 54 in the lower mounting bracket, a bias by gravity can be achieved which will constantly tend to move the shutters toward the closed position. Still other forms of bias can be used within the spirit of the invention and the scope of the claims which follow.

The embodiments of the invention in which an exclusive property or privilege is claimed are defined as follows:

1. In an exhaust fan assembly with anti-back draft shutters for use in ventilating a building structure, said assembly including:

a. a casing having an air passageway therethrough and aligned intake and exhaust ports defining said passageway, said casing being mounted in and providing an opening through a wall of a building structure to be ventilated;

b. an exhaust fan motor and attached fan blade operably mounted in said casing passageway with the motor adjacent said intake port and the fan blade adjacent said exhaust port;

c. a pair of shutters each pivotably mounted on a substantially vertical axis in said casing passageway between said motor and said intake port, said shutters being movable between an open position allowing substantially free passage of air through said casing intake port, past said motor and out said casing exhaust port and a closed position wherein said shutters are in sealing relation to each other and said casing intake port preventing passage of air back through said casing in direction from said exhaust port to said intake port; the improvement wherein:

A. each of said shutters is supported on its own pair of upper and lower parallel shutter support arms, said arms extending substantially horizontally outwardly from upper and lower vertically aligned edge corners of said shutter, respectively, and in substantially perpendicular relation to said shutter;

B. Each of the upper and lower shutter support arms is provided with a perpendicularly and vertically extending shutter pivot finger, the upper and lower fingers related to the support arms of each shutter being substantially vertically aligned with each other;

C. means is provided to pivotally mount such upper and lower pivot fingers of each of said shutters in adjacent relation to the upper and lower pivot fingers of the other of such shutters, respectively, in position so that the shutters can move between an open position wherein the shutters approach parallel relation with respect to each other with the motor in between them under the action of air being exhausted by said exhaust motor and fan and said closed position; and D. means is provided to normally bias said shutters to move from the open toward the closed position.

2. The assembly of claim 1 wherein:

E. said bias means includes a coil spring positioned in surrounding relation to two of said pairs of pivot fingers and to act on the support arms integral with those fingers.

* * * * *